US007654395B2

(12) United States Patent
Johnson et al.

(10) Patent No.: US 7,654,395 B2
(45) Date of Patent: Feb. 2, 2010

(54) SCREENING MODULE

(75) Inventors: Ronald Leslie Johnson, Charlestown (AU); Ronald Keith McGregor, Adamstown (AU)

(73) Assignee: Weatherford Australia Pty Limited, Malaga (AU)

( * ) Notice: Subject to any disclaimer, the term of this patent is extended or adjusted under 35 U.S.C. 154(b) by 474 days.

(21) Appl. No.: 10/595,950

(22) PCT Filed: Nov. 24, 2004

(86) PCT No.: PCT/AU2004/001637

§ 371 (c)(1),
(2), (4) Date: May 22, 2006

(87) PCT Pub. No.: WO2005/051554

PCT Pub. Date: Jun. 9, 2005

(65) Prior Publication Data

US 2007/0068853 A1 Mar. 29, 2007

(30) Foreign Application Priority Data

Nov. 25, 2003 (AU) ..... 2003906517

(51) Int. Cl.
*B07B 1/49* (2006.01)

(52) U.S. Cl. ..... 209/399; 209/405

(58) Field of Classification Search ..... 209/409–412, 209/399, 405, 408, 403
See application file for complete search history.

(56) References Cited

U.S. PATENT DOCUMENTS 4,141,821 A * 2/1979 Wolff ..... 209/405
4,222,865 A * 9/1980 Valeri et al. ..... 209/399
4,486,302 A * 12/1984 Jorgensen ..... 209/399
4,661,245 A * 4/1987 Rutherford et al. ..... 209/399
5,213,217 A * 5/1993 Galton et al. ..... 209/399
6,267,246 B1 * 7/2001 Russell et al. ..... 209/399
2003/0052048 A1 * 3/2003 Eeles et al. ..... 209/405

FOREIGN PATENT DOCUMENTS

| | | |
|---|---|---|
| AU | 199897218 | 3/1999 |
| AU | 200017523 | 8/2000 |
| WO | WO 00/53343 | 9/2000 |
| WO | WO 01/41944 | 6/2001 |

OTHER PUBLICATIONS

International Search Report for Application No. PCT/AU2004/001637, dated Dec. 14, 2004.

* cited by examiner

*Primary Examiner*—Patrick H Mackey
*Assistant Examiner*—Mark Hageman
(74) *Attorney, Agent, or Firm*—Patterson & Sheridan, L.L.P.

(57) ABSTRACT

A screening module for a screening assembly includes a panel member having a periphery defined by a pair of opposed, parallel sides and a pair of opposed parallel ends. A mounting formation is arranged about at least a part of the periphery of the panel member for mounting the panel member on an underlying frame. A plurality of discrete aperture arrays are defined in a surface of the body member. A skirt portion circumscribes each aperture array, each skirt portion depending from a lower surface of the panel member. A reinforcing arrangement is arranged beneath each aperture array, the reinforcing arrangement being bounded by its associated skirt portion.

15 Claims, 4 Drawing Sheets

SCREENING MODULE

CROSS-REFERENCE TO RELATED APPLICATIONS

The present application claims priority from Provisional Patent Application No. 2003906517 filed on 25 Nov. 2003, the contents of which are incorporated herein by reference.

FIELD OF THE INVENTION

This invention relates to the screening of materials. More particularly, the invention relates to a screening module for use in a screening assembly which screens material to classify or sort the material. The invention also relates to a screening assembly including the screening module.

BACKGROUND TO THE INVENTION

Screening arrangements are widely used in the mining industry, particularly the coal mining industry, for the screening or classifying of ores and slurries. Material to be screened is passed over a vibratory screen deck. Apertures of screening panels arranged on the screen deck pass material having dimensions smaller than the apertures of the screen panels while materials having dimensions larger than those of the screening apertures are retained on a top surface of, and traverse, the panels of the screen deck for further processing.

Particularly with very fine apertures, the rigidity of the screening panel must be retained so that the apertures do not distort and pass materials larger than the aperture size. However, with these fine apertures, there is a danger of the apertures becoming blocked or blinding so that, what may be undesirable material, traverses the screen deck and is also subjected to further processing.

There is therefore a compromise between the need for a rigid panel and the need to inhibit blinding of the apertures.

SUMMARY OF THE INVENTION

According to the invention, there is provided a screening module for a screening assembly, the screening module including:

a panel member having a periphery defined by a pair of opposed, parallel sides and a pair of opposed parallel ends;

a mounting formation arranged about at least a part of the periphery of the panel member for mounting the panel member on an underlying frame;

a plurality of discrete aperture arrays defined in a surface of the body member;

a skirt portion circumscribing each aperture array, each skirt portion depending from a lower surface of the panel member, and a reinforcing arrangement arranged beneath each aperture array, the reinforcing arrangement being bounded by its associated skirt portion.

Each aperture array may be substantially rectangular (including square) when viewed in plan or from below.

Each reinforcing arrangement may include at least one reinforcing member extending from a part of the skirt portion on one side of its associated aperture array to a part of the skirt portion on an opposed side of the aperture array. Preferably, the at least one reinforcing member is a bar-shaped element or rib which is arranged beneath the aperture array.

Secondary reinforcing elements may extend outwardly from the reinforcing member. The secondary reinforcing elements may comprise a series of spaced, parallel fin-like elements arranged transversely to the reinforcing member and extending from the reinforcing member to the skirt portion.

Steel reinforcing may be omitted from the module or, instead, steel reinforcing may be arranged in the mounting formation and/or in the panel member itself in regions between the aperture arrays. Where steel reinforcing, for example, round bar is used, it may be at least partially embedded in the panel member, between the aperture arrays, to control module shrinkage. The reinforcing arrangement may be without steel reinforcing.

The mounting formation may comprise a plurality of clips. The clips may be integrally formed with the panel member as a one-piece unit. The clips may extend along both ends and both sides of the panel member.

In this regard, it is to be noted that the panel member may be substantially rectangular in outline with the ends shorter than the sides. The apertures, which may be in the form of slits, may extend parallel to the ends. The ends may be arranged parallel to a direction of flow of material over the screening deck, in use. Instead, the slits may be arranged at right angles to the ends to provide a cross-flow arrangement.

The skirt portions may be arranged such that channels are defined between adjacent parts of skirt portions of adjacent aperture arrays, the channels being dimensioned to be a sliding fit over support members of the underlying frame. Each channel may permit vertical displacement of the panel member relative to the underlying support members to permit a degree of damped, or controlled, sliding movement between the skirt portions and the support members to facilitate dislodging of material blinding apertures of the screening module by the panel member of the screening module impacting against the support members. It will therefore be appreciated that the skirt portions grip the support members without engaging them in a clipping or locking manner.

The invention extends also to a screening assembly which includes

- a plurality of screening modules, each as described above; and
- a support frame on which the screening modules are removably mounted.

The support frame may have rails to be engaged by the mounting formation of the module. In addition, the support frame may include support members which underlie the panel member of each screening module the support members spanning the space between adjacent, parallel rails of the frame.

The support frame may be a demountable frame.

BRIEF DESCRIPTION OF THE DRAWINGS

An embodiment of the invention is now described by way of example with reference to the accompanying drawings in which.

DETAILED DESCRIPTION OF EXEMPLARY EMBODIMENT

Figure 1:
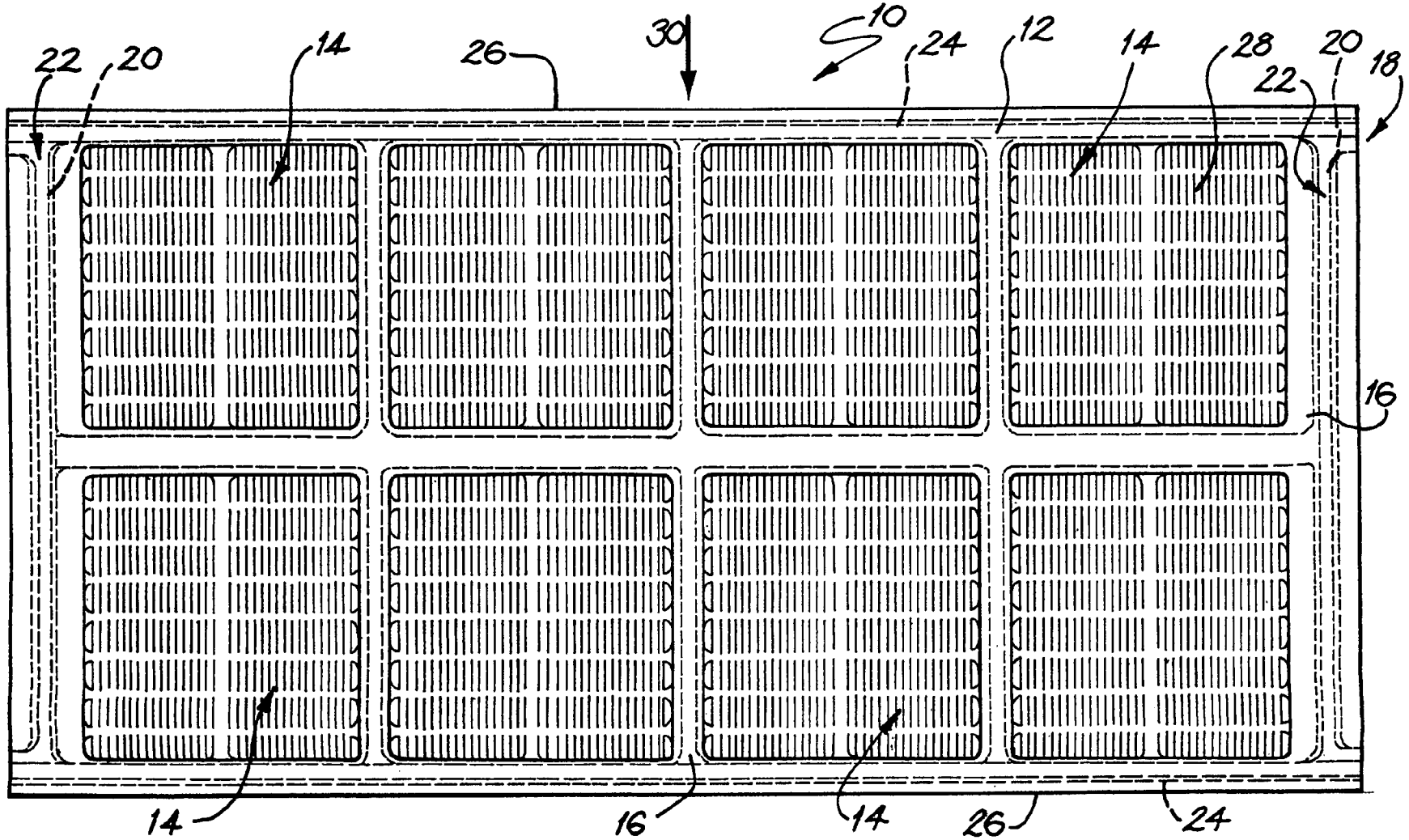
FIG. 1 shows a plan view of a screening module, in accordance with an embodiment of the invention.

In the drawings, reference numeral 10 generally designates a screening module, in accordance with an embodiment of the invention.

The module 10 comprises a panel member 12 defining a plurality of discrete aperture arrays 14. It will be noted that a matrix of aperture arrays 14 is defined in the panel member 12. Each array 14 is separated from its neighbouring array/s by material 16 of the panel member 16.

The screening module 10 includes a mounting formation 18 in the form of a plurality of clips 20, 24 arranged about a periphery of the panel member 12. A clip 20 is provided at each end 22 of the panel member 12. In addition, a clip 24 is provided along each side 26 of the panel member 12. The panel member 12 is substantially rectangular in shape having shorter ends 22 and longer sides 24. In use, the ends 22 are arranged parallel to a direction of flow of material over the panel member 12 as generally indicated by the arrow 30. It is also to be noted that the apertures 28 of each aperture array 14 are in the form of elongate openings, such as slits. A longitudinal dimension of the apertures 28 extends in a direction parallel to the flow of material, i.e. parallel to the ends 22 of the panel member 12. In a cross-flow module 10, the apertures 28 are arranged with their longitudinal dimension at right angles to the ends 22 of the panel member 12.

The clips 20, 24 are integrally formed with the panel member 12 as a one piece moulding. The screening module 10 is a moulding of a suitable polyurethane material having the requisite hardness. In this regard, the module 10, preferably, but not essentially, excludes any form of steel reinforcing and, as such, is made of a harder polyurethane, typically a polyurethane having a Shore Hardness of 93A or 95A.

The apertures 28 of the aperture arrays 14 of the panel member 12 typically have a width of from about 0.2 mm to 5 mm, in particular about 0.3 mm to 3 mm and, optimally, about 0.5 mm to pass materials smaller than half a millimeter. To cater for such fine apertures, a thinner section of polyurethane is required.

To ensure that this thinner section of polyurethane is not too flexible, a reinforcing arrangement 32 is associated with each aperture array 14. Each reinforcing arrangement 32 is arranged on a lower surface of the panel member 12 below its associated aperture array 14. The reinforcing arrangements 32 are also of polyurethane and are integrally moulded with the panel member 12 as a one-piece moulding.

Figure 4:
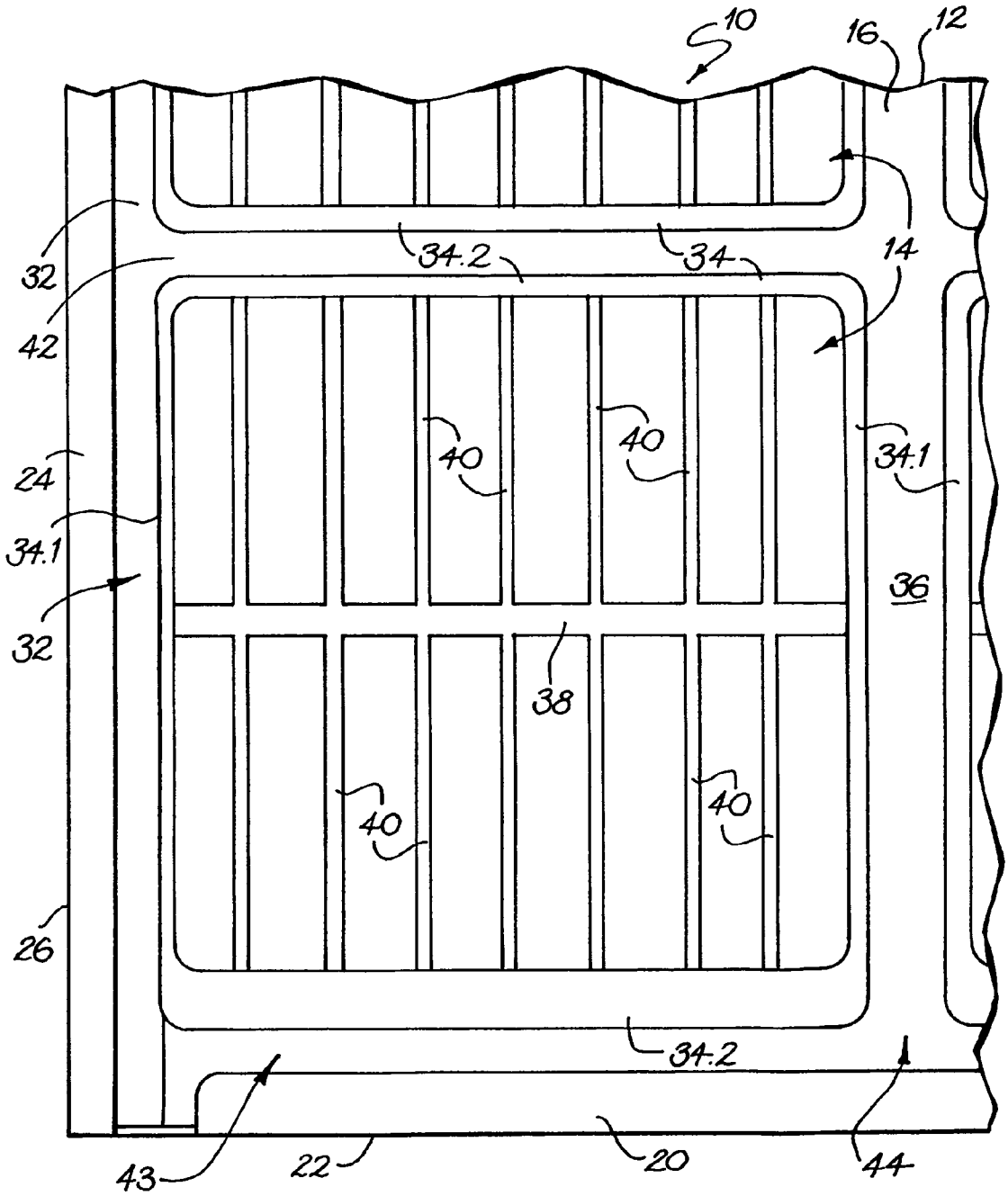
FIG. 4 shows, on an enlarged scale, a bottom view of a part of the screening module.

One of the reinforcing arrangements 32 is shown in greater detail in FIG. 4 of the drawings which shows a bottom view of part of the screening module 10. It is to be noted that the apertures 28 are omitted from FIG. 4 for the sake of clarity.

Figure 2:
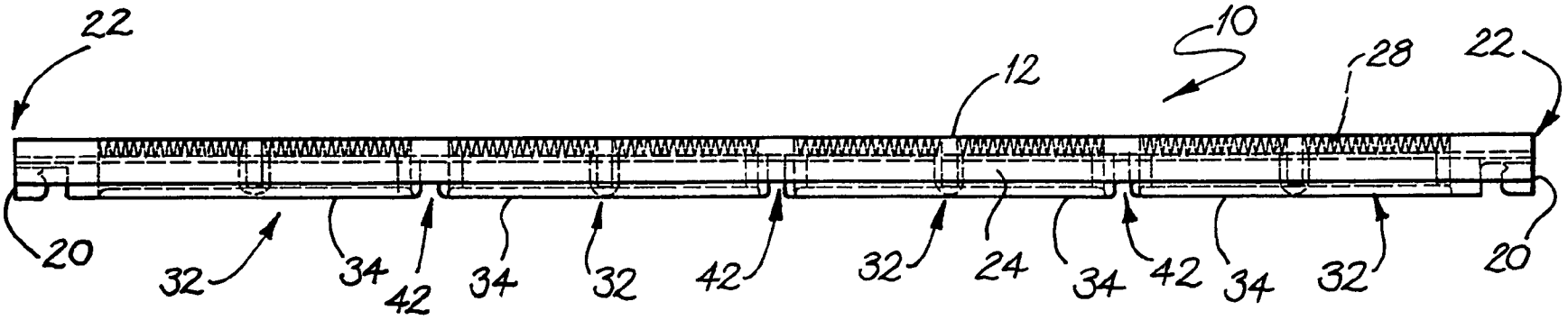
FIG. 2 shows a side view of the screening module.

The reinforcing arrangement 32 of each aperture array 14 comprises a skirt portion 34 depending from a lower surface 36 of the panel member 12. This is best seen in FIG. 2 of the drawings. For an eight aperture array arrangement as shown in the drawings, each aperture array 14 is substantially square in outline so that the skirt portion 34 bounds a substantially square region. For other aperture arrays, such as a three aperture array (not shown) where three arrays are arranged in equally spaced relationship in the panel member 12, the aperture arrays are substantially rectangular and the skirt portion 34 bounds a rectangular region. A reinforcing member in the form of a rib 38 extends between opposed parts 34.1 of the skirt portion 34. Secondary reinforcing elements in the form of fins 40 project laterally from the rib 38 to the other opposed sides 34.2 of the skirt portion 34. With this arrangement, each aperture array 14 is reinforced to inhibit excessive flexing of the aperture arrays 14.

Figure 3:
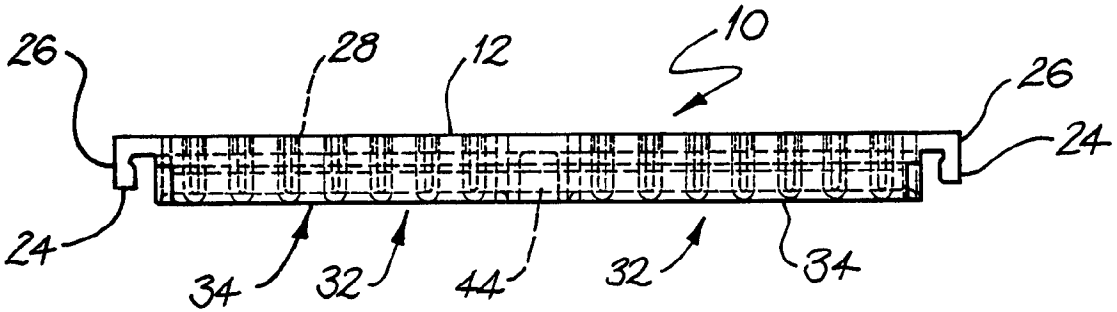
FIG. 3 shows an end view of the screening module.

Adjacent parts 34.2 of adjacent skirt portions 34 and, similarly, adjacent parts 34.1 of adjacent skirt portions 34 of the aperture arrays 14, define channels 42 and 44, respectively, between adjacent aperture arrays 14 as best seen in FIGS. 2 and 3 of the drawings.

Figure 5:
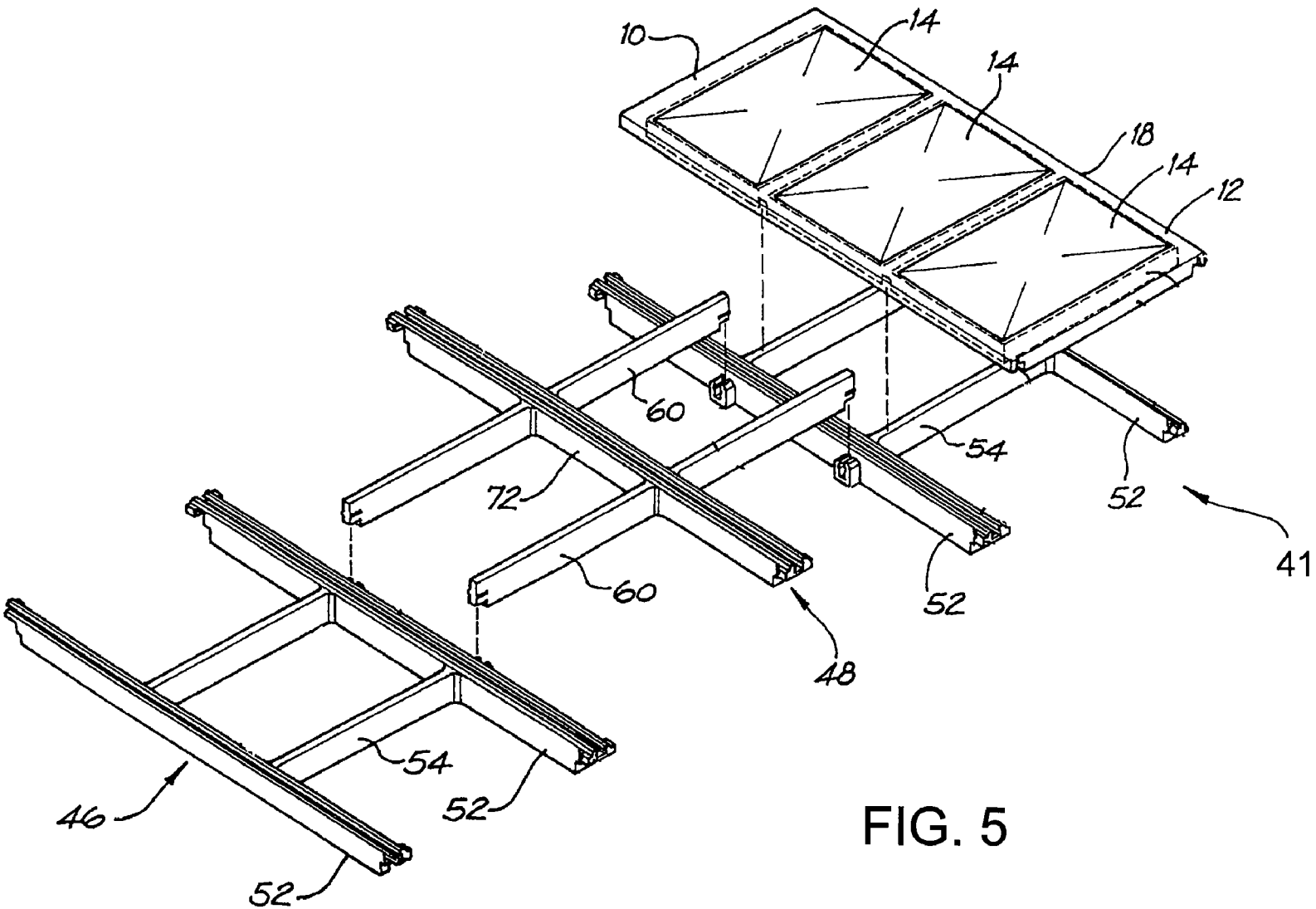
FIG. 5 shows a plan view of a frame in accordance with an embodiment of the invention.

These channels 42, 44 are dimensioned so that underlying support members, for example support members 54 and 60 of frames 41, 46, and 48 shown in FIG. 5, via which the screening modules 10 are mounted on a screen deck, are a tight fit to control, but not entirely eliminate, sliding movement in a direction perpendicular to a plane in which the panel member 12 lies. The support members are, to a large extent, gripped by these channels 42, 44 with the support members assisting in imparting rigidity to the screening modules 10. It is to be noted that the channels 42, 44 are deeper than a slot 43 adjacent the clip 20 to accommodate the support members of the frame. The frame frames 41, 46, and 48 also carries rails 52 and 72 thereon which are engaged by the clips 20, 24 of the screening modules 10. The frame is shown in the Applicant's Australian Patent No. 771083 and corresponding U.S. Pat. No. 6,715,613, both entitled "A screening module and a screening assembly including such module" and the contents of both of which are incorporated by reference in this specification.

The channels 42, 44 receive the steel support members of the frame. However, as indicated above, an inner part of the panel member 12 is displaceable vertically, to a limited extent, with respect to the support members. This allows striking of the panel member 12 against the support members which aids in clearing blocked apertures 28 of the aperture arrays 14 of the panel member 12.

It is therefore an advantage of the invention that a screening module 10 is provided which has sufficient flexibility to inhibit blinding of the apertures 28 but is rendered sufficiently rigid, due to the reinforcing arrangements 32 and the cooperation with the support members of the underlying frame, to screen materials passing over the screening modules 10 with the required degree of accuracy. The fact that the support members are not clipped to the underside of the panel member 12 also facilitates clearing of blocked apertures 28 of the screening module 10 as relative movement between at least part of the panel member 12 of the screening module 10 and the support members is permitted.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A screening module for a screening assembly, the screening module including:

a panel member having a periphery defined by a pair of opposed, parallel sides and a pair of opposed parallel ends;

a mounting formation arranged about at least a part of the periphery of the panel member for mounting the panel member on an underlying frame;

a plurality of discrete aperture arrays defined in a surface of the panel member;

a skirt portion circumscribing each aperture array, each skirt portion depending from a lower surface of the panel member; and a reinforcing arrangement arranged beneath each aperture array.

2. The module of claim 1 in which each aperture array is substantially rectangular when viewed in plan.

3. The module of claim 1 in which each reinforcing arrangement includes at least one reinforcing member extending from a part of the skirt portion on one side of its associated aperture array to a part of the skirt portion on an opposed side of the aperture array.

4. The module of claim 3 in which the at least one reinforcing member is a rib which is arranged beneath the aperture array.

5. The module of claim 3 in which secondary reinforcing elements extend outwardly from the reinforcing member.

6. The module of claim 5 in which the secondary reinforcing elements comprise a series of spaced, parallel elements arranged transversely to the reinforcing member and extending from the reinforcing member to the skirt portion.

7. The module of claim 1 in which the mounting formation comprises a plurality of dips.

8. The module of claim 7 in which the clips are integrally formed with the panel member a one-piece unit.

9. The module of claim 1 in which the skirt portions are arranged such that channels are defined between adjacent parts of skirt portions of adjacent aperture arrays, the channels being dimensioned to be a sliding fit over support members of the underlying frame.

10. The module of claim 9 in which each channel permits vertical displacement of the panel member relative to the underlying support members to facilitate dislodging of material blinding apertures.

11. The module of claim 1, wherein the reinforcing arrangement is bounded by its associated skirt portion.

12. A screening assembly which include: a plurality of screening modules, each as claimed in claim 1; and a support frame on which the screening modules are removably mounted.

13. The assembly of claim 12 in which the support frame has rails to be engaged by the mounting formation of the module.

14. The assembly of claim 13 in which the support frame includes support members which underlie the panel member of each screening module the support members spanning the space between adjacent, parallel rails of the frame.

15. The assembly of claim 12 in which the support frame is a demountable frame.

* * * * *

UNITED STATES PATENT AND TRADEMARK OFFICE

CERTIFICATE OF CORRECTION

PATENT NO. : 7,654,395 B2
APPLICATION NO. : 10/595950
DATED : February 2, 2010
INVENTOR(S) : Johnson et al.

It is certified that error appears in the above-identified patent and that said Letters Patent is hereby corrected as shown below:

Column 5, Claim 7, Line 12, please delete "dips" and insert --clips-- therefor;

Column 5, Claim 8, Line 15, please insert --as-- after member;

Column 6, Claim 12, Line 7, please delete "include" and insert --includes-- therefor.

Signed and Sealed this

Eleventh Day of May, 2010

David J. Kappos

David J. Kappos
*Director of the United States Patent and Trademark Office*